US011136793B2

(12) United States Patent
Nagaoka et al.

(10) Patent No.: US 11,136,793 B2
(45) Date of Patent: Oct. 5, 2021

(54) VEHICLE DOOR LATCH APPARATUS

(71) Applicant: MITSUI KINZOKU ACT CORPORATION, Yokohama (JP)

(72) Inventors: Tomoharu Nagaoka, Yokohama (JP); Hideaki Nozawa, Yokohama (JP)

(73) Assignee: MITSUI KINZOKU ACT CORPORATION, Yokohama (JP)

( * ) Notice: Subject to any disclaimer, the term of this patent is extended or adjusted under 35 U.S.C. 154(b) by 549 days.

(21) Appl. No.: 16/092,426

(22) PCT Filed: Sep. 21, 2016

(86) PCT No.: PCT/JP2016/077818
§ 371 (c)(1),
(2) Date: Oct. 9, 2018

(87) PCT Pub. No.: WO2017/179227
PCT Pub. Date: Oct. 19, 2017

(65) Prior Publication Data

US 2019/0128026 A1 May 2, 2019

(30) Foreign Application Priority Data

Apr. 14, 2016 (JP) ..... JP2016-081580

(51) Int. Cl.
*E05B 77/32* (2014.01)
*E05B 81/36* (2014.01)
(Continued)

(52) U.S. Cl.
CPC ..... *E05B 77/32* (2013.01); *E05B 81/16* (2013.01); *E05B 81/18* (2013.01); *E05B 81/36* (2013.01); *E05Y 2900/531* (2013.01)

(58) Field of Classification Search
CPC ..... E05B 77/32; E05B 81/16; E05B 81/18; E05B 81/36; E05B 85/24; E05B 85/26; Y10T 292/1047
See application file for complete search history.

(56) References Cited

U.S. PATENT DOCUMENTS 5,642,636 A * 7/1997 Mitsui ..... E05B 17/0062 292/201
6,371,536 B1 * 4/2002 Koerwer ..... E05B 81/14 292/201
(Continued)

FOREIGN PATENT DOCUMENTS

JP 2004-044360 A 2/2004
JP 2004-143864 A 5/2004
(Continued)

OTHER PUBLICATIONS

International Search Report for PCT Application No. PCT/JP2016/077818, dated Nov. 8, 2016 in 1 page.

*Primary Examiner* — Kristina R Fulton
*Assistant Examiner* — Christopher F Callahan
(74) *Attorney, Agent, or Firm* — Knobbe, Martens, Olson & Bear, LLP

(57) ABSTRACT

A vehicle door latch apparatus is provided that shortens the time to switch the locking lever between the locked position and the unlocked position. A vehicle door latch apparatus according to the present invention comprises a latch that is engaged with a striker in order to keep a vehicle door in a half-latched state or a full-latched state; a ratchet that is engaged with the latch in order to keep the latch engaged with the striker; an opening link 27 that abuts against the ratchet in order to release the ratchet from the latch when the opening link is moved in a door opening direction in an door opening operation of an outer door opening handle; a locking lever 28 that can be switched between a locked
(Continued)

position that prevents the ratchet from being released by the opening link and an unlocked position that allows the ratchet to be released; and a locking actuator 39 that switches the locking lever between the locked position and the unlocked position. The locking actuator includes a motor 40 and an output wheel 42 that is driven by the motor, and the output wheel has a protruding or recessed first connecting part 45 and the locking lever has a recessed or protruding second connecting part 46 that is connected to the first connecting part.

8 Claims, 9 Drawing Sheets

(51) Int. Cl.
*E05B 81/18* (2014.01)
*E05B 81/16* (2014.01)

(56) References Cited

U.S. PATENT DOCUMENTS

2013/0161961 A1 6/2013 Burciaga et al.
2016/0160537 A1* 6/2016 Estrada ..... E05B 77/38
292/241

FOREIGN PATENT DOCUMENTS

WO WO-2011094834 A1 * 8/2011 ..... E05B 81/70
WO WO-2013170363 A1 * 11/2013 ..... E05B 81/06

* cited by examiner

VEHICLE DOOR LATCH APPARATUS

CROSS-REFERENCE TO RELATED APPLICATIONS

This application is the U.S. National Phase under 35. U.S.C. § 371 of International Application PCT/JP2016/077818, filed Sep. 21, 2016, which claims priority to Japanese Patent Application No. 2016-081580, filed Apr. 14, 2016. The disclosures of the above-described applications are hereby incorporated by reference in their entirety.

BACKGROUND OF THE INVENTION

1. Field of the Invention

The present invention relates to a door latch apparatus, and particularly to a locking actuator of a door latch apparatus.

2. Description of the Related Art

A conventional door latch apparatus generally includes a latch that is engaged with a striker in order to keep the vehicle door in a half-latched state or a full-latched state, a ratchet that is engaged with the latch in order to keep the latch engaged with the striker, an opening link that abuts with the ratchet to release the ratchet from the latch when the opening link is moved in the door opening direction by a door opening operation of the outer door opening handle and a locking lever that can be switched between the locked position that prevents the ratchet from being released by the opening link and the unlocked position that allows the ratchet to be released (JP2004-44360, JP2004-143864). A motor-driven locking actuator may also be provided that switches the locking lever between the locked position and the unlocked position. Such a locking actuator switches the locking lever between the locked position and the unlocked position by rotating a motor-driven output wheel.

SUMMARY OF THE INVENTION

The output of a motor-driven locking actuator largely varies depending on the voltage of the battery (a voltage applied to the motor) and the ambient temperature. Thus, the reduction ratio of the locking actuator tends to be set large for safety. However, the reduction ratio may be too large, for example, for an arrangement in which the locking lever has a small displacement resistance, i.e., an arrangement in which a locking knob, which is used in a manual operation to switch the locking lever from inside the vehicle, is not connected to the locking lever. As a result, switching of the locking lever may take quite a long time and this may create feeling that the operation is not working properly. In addition, if the switching of the locking lever requires a long time, a panic state (a state in which both the operation to switch the locking lever to the unlocked state and the operation to open the door, by activating the door opening handle, fail to function when these two operations are substantially conducted at one time and both operations then need to be repeated) may easily occur.

It is an object of the present invention to provide a vehicle door latch apparatus that shortens the time to switch the locking lever between the locked position and the unlocked position.

A vehicle door latch apparatus according to the present invention comprises a latch that is engaged with a striker in order to keep a vehicle door in a half-latched state or a full-latched state; a ratchet that is engaged with the latch in order to keep the latch engaged with the striker; an opening link that abuts against the ratchet in order to release the ratchet from the latch when the opening link is moved in a door opening direction in an door opening operation of an outer door opening handle; a locking lever that can be switched between a locked position that prevents the ratchet from being released by the opening link and an unlocked position that allows the ratchet to be released; and a locking actuator that switches the locking lever between the locked position and the unlocked position. The locking actuator includes a motor and an output wheel that is driven by the motor, and the output wheel has a protruding or recessed first connecting part and the locking lever has a recessed or protruding second connecting part that is connected to the first connecting part.

According to the present invention, the rotation of the output wheel is directly transferred to the locking lever by the protruding or recessed first connecting part and the recessed or protruding second connecting part that is connected to the first connecting part. Therefore, the time for switching the locking lever (opening lever) can be shortened by reducing the rotation angle of the output wheel when the locking lever is switched between the locked position and the unlocked position.

DETAILED DESCRIPTION OF THE INVENTION

Figure 1:
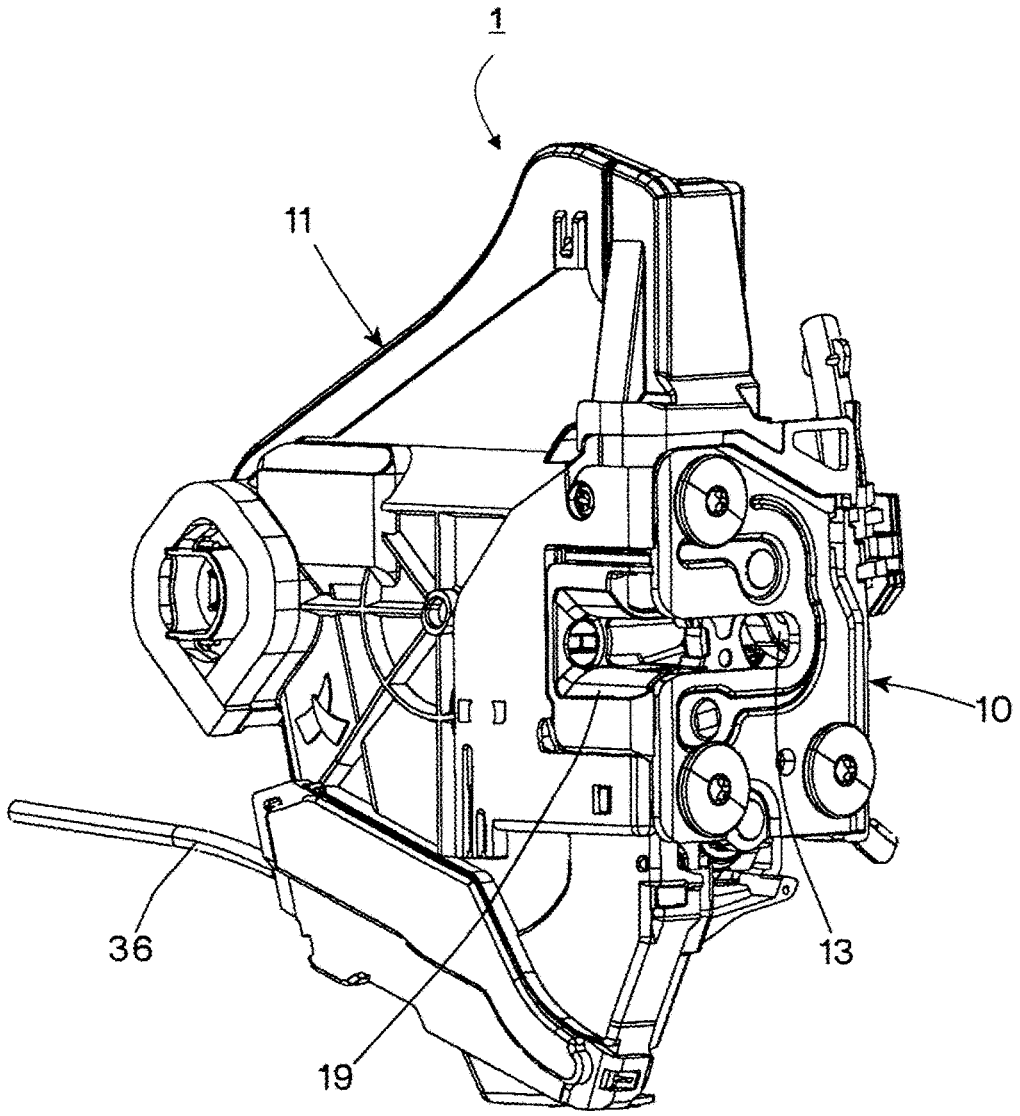
FIG. 1 is a general perspective view of a vehicle door latch apparatus according to an embodiment of the present invention.

A vehicle door latch apparatus according to a preferable embodiment of the present invention will be described with reference to the drawing. Vehicle door latch apparatus 1 is constituted of latch part 10 that has a latch/ratchet mechanism and operation part 11 that is integrally or separately connected to latch part 10. Latch part 10 is engaged with striker 12 (FIG. 2) that is provided on the vehicle main body in order to keep the door closed. Operation part 11 includes an opening mechanism, a locking mechanism and so on. Latch part 10 and operation part 11, when integrally formed, typically has a substantially L-shaped form as a whole, as seen from above.

Figure 2:
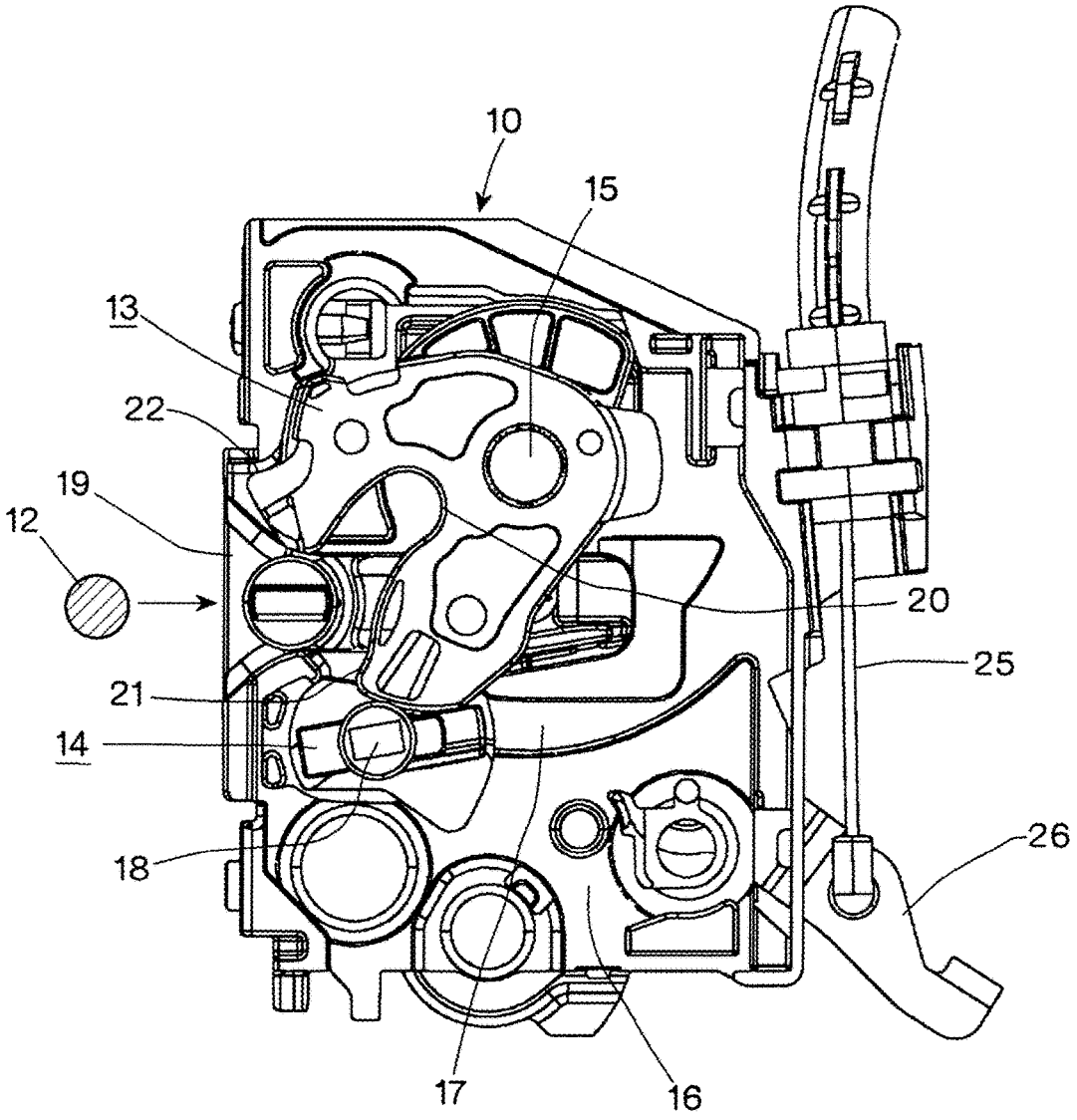
FIG. 2 is a rear view of the latch part of the vehicle door latch apparatus shown in FIG. 1, as seen from the backside of the vehicle.

Latch part 10 has latch 13 that is engaged with striker 12 when the door is closed and ratchet 14 that keeps latch 13 to be engaged with striker 12, as shown in FIG. 2. Latch 13 is rotatably supported by latch shaft 15 that extends in the vehicle forward-backward direction and is housed in housing space 17 that is open on the front side (on the back side with regard to the vehicle) of resin latch body 16. Ratchet 14 is rotatably supported by ratchet shaft 18 and is housed in housing space 17.

Latch 13 is biased in the clockwise direction in FIG. 2 by the elastic force of a latch spring (not shown) and ratchet 14 is biased in the anticlockwise direction by the elastic force of a ratchet spring (not shown). Striker 12 enters striker passage 19 of latch body 16 in a door closing operation. Latch 13 is rotated in the anticlockwise direction when striker 12 abuts against U-shaped groove 20 of latch 13 in the unlatched position. When latch 13 is rotated to the half-latched position, the claw of ratchet 14 is engaged with first step 21 of latch 13 so that the half-latched state is created. When latch 13 is further rotated to the full-latched position, the claw of ratchet 14 is engaged with second step 22 of latch 13 so that the door is kept in the full-latched state.

Figure 3:
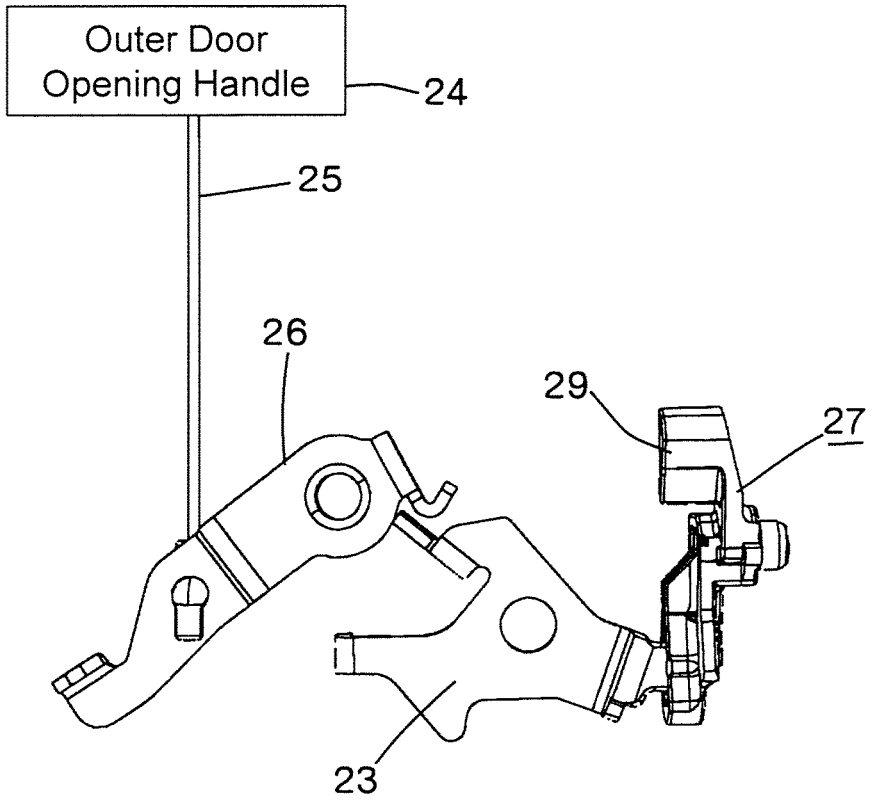
FIG. 3 is a schematic view of the operation part that is provided on the back side of the latch body of the vehicle door latch apparatus shown in FIG. 1.
Figure 6:
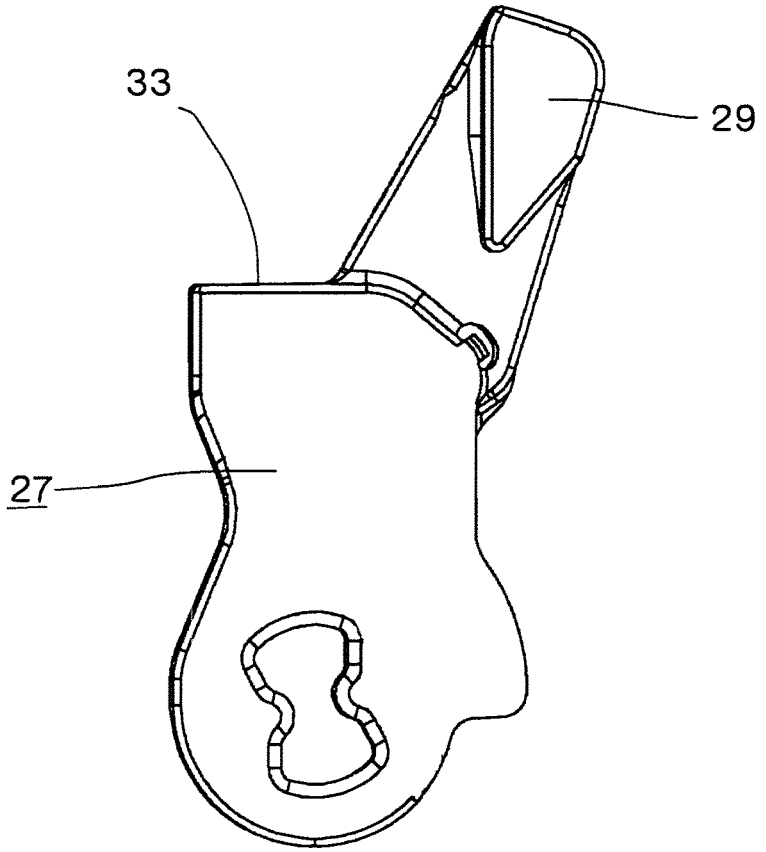
FIG. 6 is an enlarged view of the opening link of the operation part.

Opening lever 23 is rotatably supported on the back side of latch body 16, as shown in FIG. 3. Outer lever 26 is arranged on the left side of opening lever 23. Outer lever 26 is connected to outer door opening handle 24 via connecting part 25, such as a rod. The door opening operation of outer door opening handle 24 is transferred to opening lever 23 via outer lever 26. The right end of opening lever 23 is connected to the lower part of opening link 27 (FIG. 6). When outer door opening handle 24 is operated in the door opening direction, opening link 27 is raised from the initial position (the waiting position).

Figure 4:
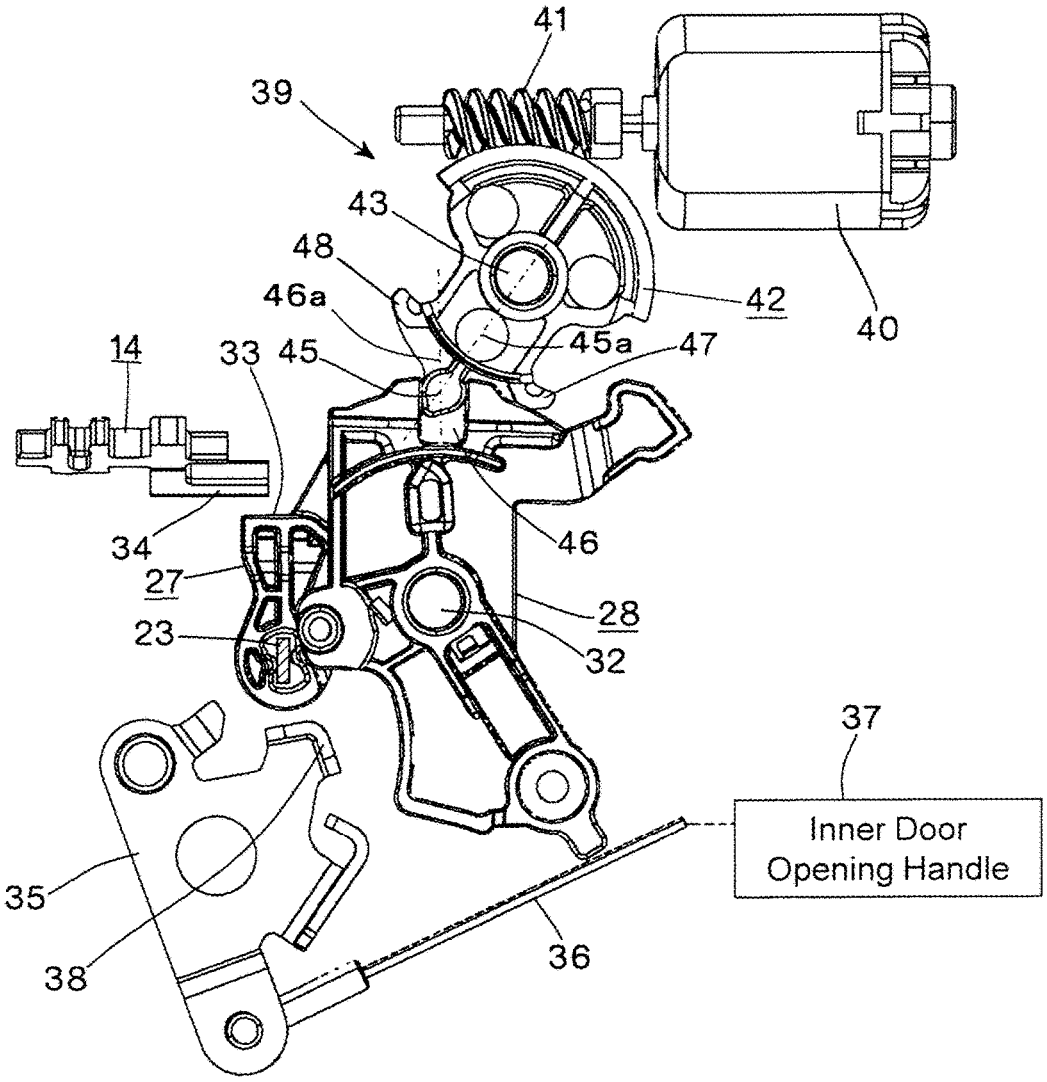
FIG. 4 is a side view of the operation part as seen from the outside of the vehicle.
Figure 7:
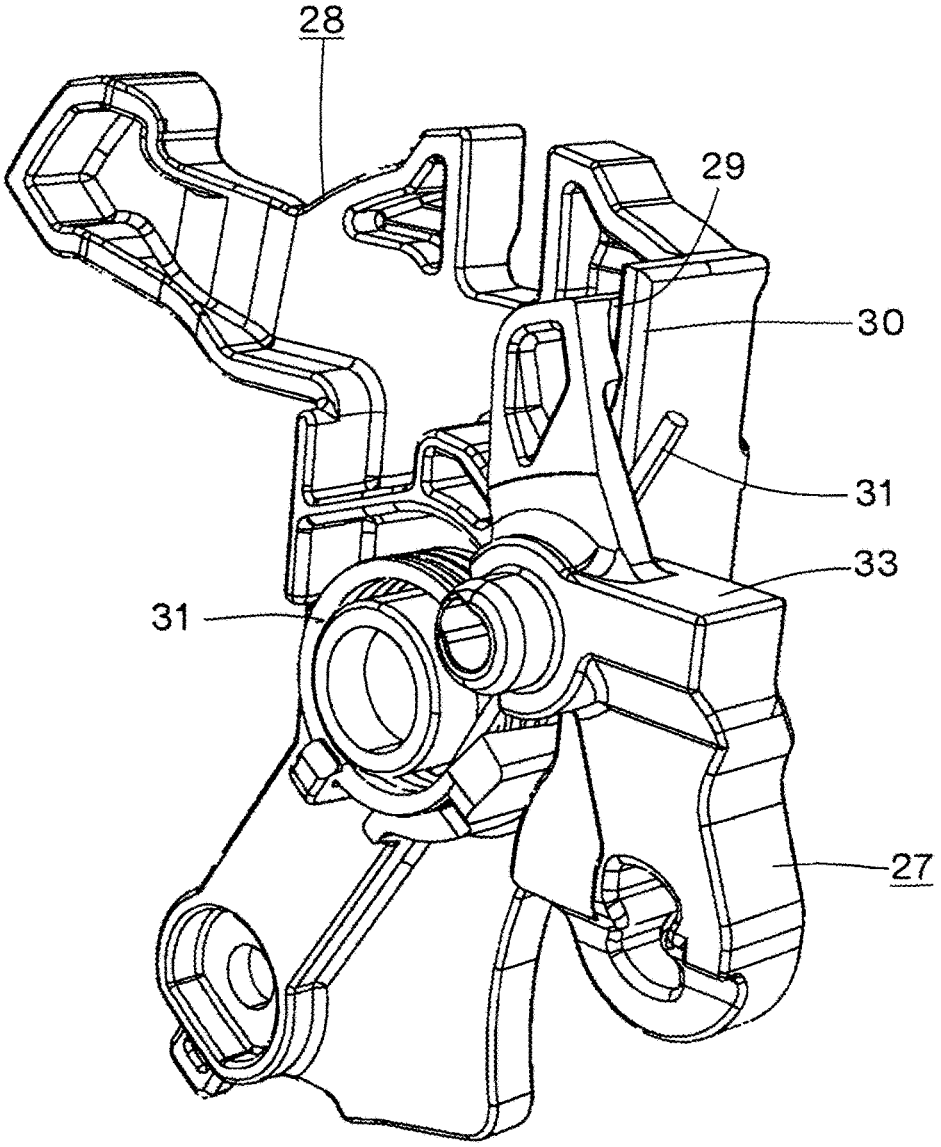
FIG. 7 is an enlarged perspective view of the opening link and the locking lever.
Figure 8:
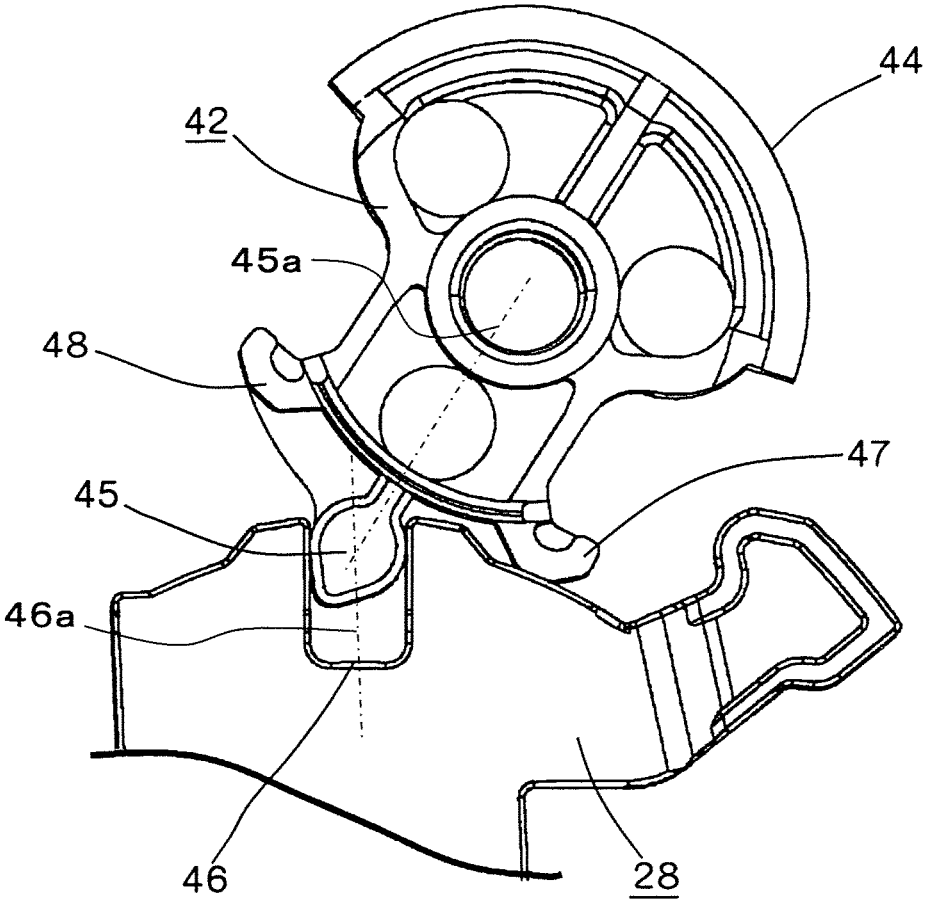
FIG. 8 is an enlarged view of the output wheel of the locking actuator and the locking lever.
Figure 9:
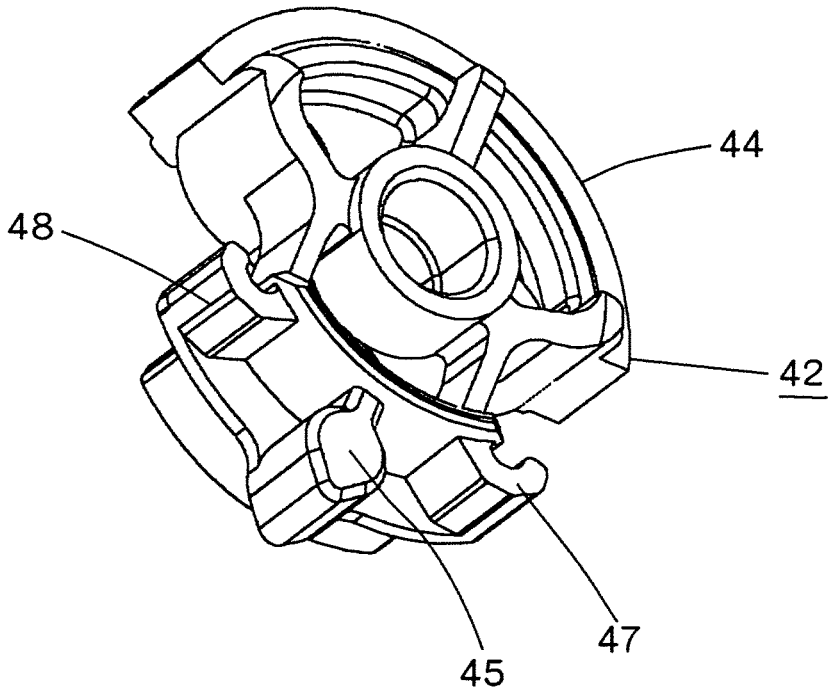
FIG. 9 is an enlarged perspective view of the output wheel.

FIG. 4 shows the internal structure of operation part 11, seen from outside of the vehicle. Various levers are rotatably supported by shafts that extend in the vehicle width direction. Locking lever 28 is arranged on the lateral side of opening link 27. Sliding protrusion 29 that extends toward the outside of the vehicle is formed on the upper part of opening link 27. Sliding protrusion 29 is caused to abut against vertical wall 30 that is formed on the back side (vehicle interior side) of locking lever 28 (see FIG. 7). Opening link 27 is biased in the anticlockwise direction in FIG. 4 by the elastic force of anti-panic spring 31 and sliding protrusion 29 is kept abutting against wall 30 due to the biasing force.

Figure 5:
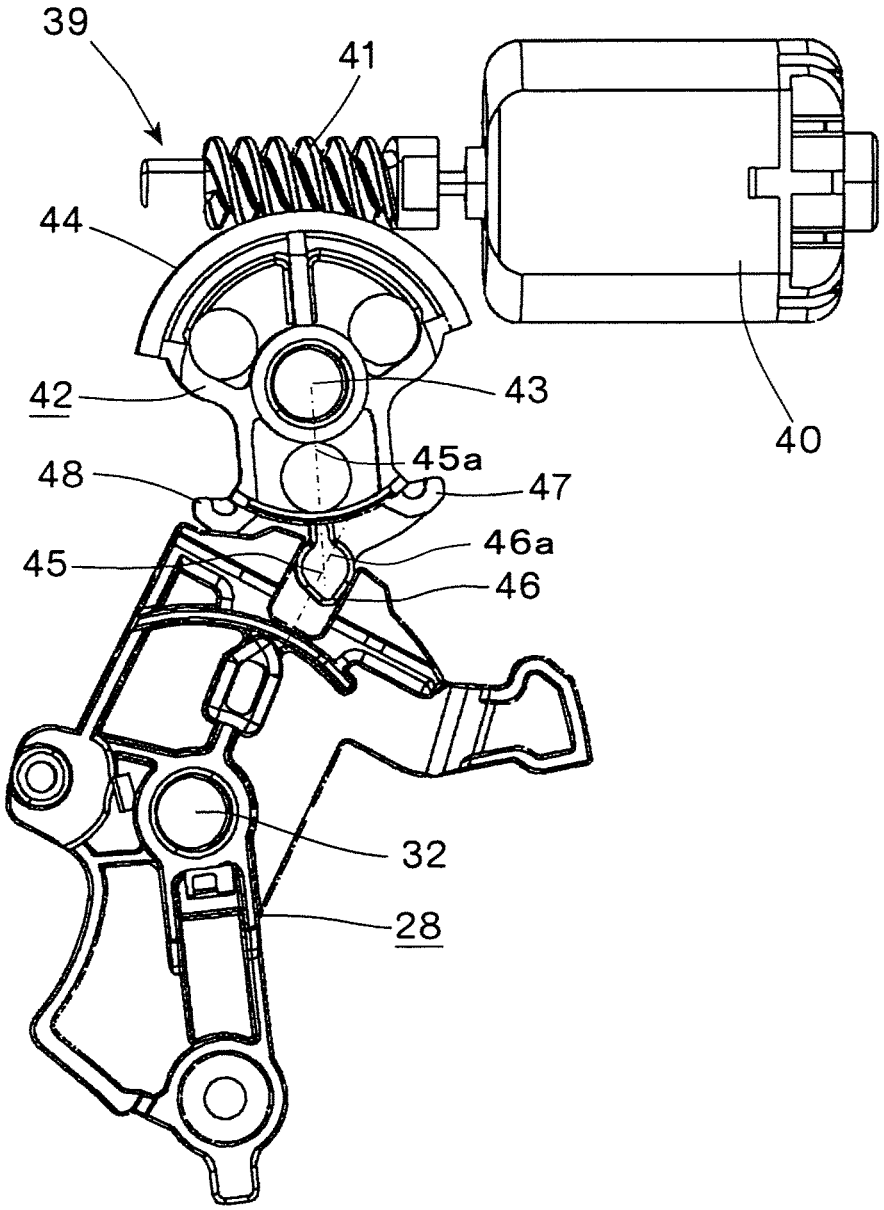
FIG. 5 is a side view of the locking actuator and the locking lever of the vehicle door latch apparatus in the locked state, as seen from the outside of the vehicle.

Locking lever 28 is rotatably supported by locking lever shaft 32 and is switched between the unlocked position shown in FIG. 4 and the locked position shown in FIG. 5. When locking lever 28 is rotated in the locking direction (in the clockwise direction), the rotation of locking lever 28 is directly transferred to opening link 27 due to sliding protrusion 29 abutting against wall 30, and locking lever 28 and opening link 27 are moved together. When locking lever 28 is rotated in the unlocking direction (in the anticlockwise direction), the rotational force is transferred to opening link 27 via the elastic force of anti-panic spring 31.

In the unlocked state shown in FIG. 4, engaging part 33 that is formed at about the middle of opening link 27 with regard to the vertical direction faces ratchet pin 34 of ratchet 14 in the vertical direction. When opening link 27 is moved upward by the rotation of opening lever 23, engaging part 33 abuts against ratchet pin 34 from below, pushing up ratchet pin 34, then disengages ratchet 14 from latch 13 in order to put the door in the openable state. However, when locking lever 28 is rotated to the locked position in the locking direction (in the clockwise direction), engaging part 33 of opening link 27 is moved to the lateral side of ratchet pin 34 of ratchet 14 and prevents opening link 27 that is moved upwardly from conducting the door opening operation.

Anti-panic spring 31 transfers the unlocking rotation of locking lever 28 to opening link 27 via the elastic force of anti-panic spring 31. Therefore, even when opening link 27 is put in a so-called panic state, in which opening link 27 is physically prevented from rotating in the unlocking direction, locking lever 28 can be completely moved to the unlocked position while compressing anti-panic spring 31, thereby avoiding conducting the unlocking operation again. See JP2004-44360 and JP 2004-143864 for detail of the panic state and the anti-panic mechanism to prevent this state. The entity of JP 2004-143864 is hereby incorporated by reference into this specification.

As shown in FIG. 4, inner lever 35 is arranged below opening link 27. Inner door opening handle 37 is connected to inner lever 35 via connecting part 36, such as a rod. Inner lever 35 has pressing piece 38 and when inner lever 35 is rotated in the door opening operation of inner door opening handle 37, pressing piece 38 abuts against the lower end of opening link 27 and pushes up opening link 27. Thus, when in the unlocked state, ratchet 14 is disengaged from latch 13 in order to put the door in the openable state.

Locking actuator 39 that switches locking lever 28 between the locked position and the unlocked position is arranged above locking lever 28. Locking actuator 39 includes motor 40, cylindrical worm 41 that is fixed to the rotational shaft of motor 40 and output wheel 42 that is engaged with cylindrical worm 41.

Output wheel 42 is rotatably supported by gear shaft 43. Gear part 44 that is engaged with cylindrical worm 41 is formed at a part of the outer circumference of output wheel 42. Connecting part (first connecting part) 45, which is a protrusion that protrudes in the radial direction of cylindrical worm 41, is formed at a position of the outer circumference of output wheel 42 that is opposite to gear part 44 with regard to the rotational center (gear shaft 43) of output wheel 42. Protruding connecting part 45 extends along first center line **45*a* that passes through the rotational center of output wheel 42 (gear shaft 43). Locking lever 28 is provided with recessed connecting part (second connecting part) 46. Recessed connecting part 46 is a recess that extends along second center line 46*a* and that receives protruding connecting part 45. Protruding connecting part 45 is engaged with recessed connecting part 46 in a manner in which a protrusion is engaged with a recess, and the driving force of motor 40 is transferred to locking lever 28 through the protrusion-recess connection. Protruding connecting part 45 is in point contact with recessed connecting part 46 and is restricted in the circumferential direction of output wheel 42 but is not restricted in the radial direction of output wheel 42. In addition, the rotation of protruding connecting part 45 relative to recessed connecting part 46 is not restricted by recessed connecting part 46. It should be noted that the protrusion-recess relationship can be reversed, that is, recessed connecting part 46 may be formed in output wheel 42 and protruding connecting part 45 may be formed in locking lever 28**.

Since output wheel 42 is rotated about gear shaft 43 and locking lever 28 is rotated about locking lever shaft 32, the distance between protruding connecting part 45 and locking lever shaft 32 varies while locking lever 28 is rotated. Specifically, the angle that is formed between first center line **45*a* and second center line 46*a* varies while locking lever 28 is rotated. The distance is the largest when locking lever 28 is in the locked position or in the unlocked position (see FIGS. 4 and 5) and is the smallest when locking lever 28 is between the locked position and the unlocked position and first center line 45***a* and second center line 46*a* are aligned on a single line. However, the change in the distance can be accommodated since protruding connecting part 45 moves in the radial direction of output wheel 42 relative to recessed connecting part 46. Accordingly, protruding connecting part 45 is engaged with recessed connecting part 46 at all times and at any location between the locked position and the unlocked position of locking lever 28, thereby allowing output wheel 42 to rotate locking lever 28.

A pair of stoppers 47, 48 is formed at a part of the outer circumference of output wheel 42 that is opposite to gear part 44 with regard to the rotational center of output wheel 42. When output wheel 42 is rotated by a predetermined angle in the unlocking direction (in the clockwise direction in FIG. 4) and locking lever 28 is also rotated by a predetermined angle, stopper 47 for the unlocked position abuts against the outer circumferential wall of locking lever 28, and the operation of locking actuator 39 is stopped. On the other hand, when output wheel 42 is rotated by a predetermined angle in the locking direction (in the anticlockwise direction in FIG. 4) and locking lever 28 is also rotated by a predetermined angle, stopper 48 for the locked position abuts against the outer circumferential wall of locking lever 28, and the operation of locking actuator 39 is stopped.

The output of motor 40 or locking actuator 39 that is transferred from output wheel 42 to locking lever 28 largely varies depending on the battery voltage (a voltage applied to motor 40) and the ambient temperature. Thus, reduction ratio of locking actuator 39 tends to be set large for ensuring sufficient safety. As a result, the reduction ratio becomes too large for an arrangement in which the displacement resistance of locking lever 28 is small. This may lead to a considerably long time for locking lever 28 (opening link 27) to be switched in which there is a feeling that the operation is deteriorating, and thus easily causing the above-mentioned panic state. It is possible to change the reduction ratio of the gear for each type of the vehicle door latch apparatus in order to prevent such a situation, but it may result in a cost disadvantage.

In the present embodiment, the reduction ratio of locking actuator 39 is set at about the same level as a conventional level, but instead, the amount or the angle of rotation of output wheel 42 (hereinafter referred to as the predetermined amount of rotation) when locking lever 28 is switched from the locked position to the unlocked position (or vice versa) is reduced and thereby the switching time for locking lever 28 (opening link 27) is shortened. It should be noted that the displacement resistance of locking lever 28 tends to be small, for example, for a door latch apparatus that is not provided with a locking knob that is used when locking lever 28 is manually switched from inside of the vehicle. Accordingly, the arrangement in which the driving force of motor 40 is transferred to locking lever 28 by protruding connecting part 45 and recessed connecting part 46 is applicable to a door latch apparatus having the above-mentioned locking knob, but is especially and preferably applicable to a door latch apparatus that does not have the above-mentioned locking knob and in which the displacement resistance of locking lever 28 is small.

In the present embodiment, the above-mentioned predetermined amount of rotation is about 40 degrees. Therefore, it is possible to arrange protruding connecting part 45 between stopper 47 and stopper 48 and to concentrate protruding connecting part 45, stopper 47 and stopper 48 at a part of the outer circumference of output wheel 42 that is opposite to gear part 44 with regard to the rotational center of output wheel 42. This makes the arrangement of output wheel 42 suitable and facilitates fabrication. In addition, due to the small rotational angle of output wheel 42, it is possible for protruding connecting part 45 to be always engaged with recessed connecting part 46 of locking lever 28 without being disengaged from recessed connecting part 46. Moreover, it is possible to continuously keep protruding connecting part 45 in point contact with recessed connecting part 46 on both sides of protruding connecting part 45 and recessed connecting part 46 and thereby to limit the occurrence of unpleasant noise, such as chattering.

Table 1 shows the measurement of operating time of motor 40 that is required for output wheel 42 to make the predetermined amount of rotation under various battery voltages (voltage applied to motor 40) and ambient temperatures. The maximum operating time is 49.3 msec. when the ambient temperature is 80° C. and the voltage applied to motor 40 is 9V. This is about half the time required for a conventional apparatus in which the output wheel makes a large amount of rotation. The operating time of the output wheel is reduced to about half or less under other conditions, and a significant reduction of switching time for locking lever 28 (opening link 27) is achieved. In this way, in the present invention, the operating time of output wheel 42 (motor 40) can be set at 28 to 50 msec. in the temperature range of −30 to 80° C. and in the range of voltage of 9 to 16V that is applied to motor 40.

It should be noted that "Min. Switching Time To Unlocked State" in Table 1 means the amount of time that is required for engaging part 33 of opening link 27 to be moved to the position (a mechanically unlocked position) where engaging part 33 can be vertically engaged with ratchet pin 34 of ratchet 14 when opening link 27, which is moved together with locking lever 28, is switched from the locked position to the unlocked position. The panic state can be prevented because ratchet 14 can be disengaged from latch 13 by the upward movement of opening link 27 that is caused by the door opening operation of outer door opening handle 24, as long as opening link 27 is moved to the mechanically unlocked position even if the operation of locking actuator 39 has not been completed. In the embodiments, the operating time of output wheel 42 (motor 40) that is required to obtain the mechanically unlocked state can be set at 15 to 28 msec. in the temperature range of −30 to 80° C. and in the range of voltage of 9 to 16V that is applied to motor 40. Accordingly, in the present invention, "Min. Switching Time To Unlocked State" that is required to prevent the panic state can be significantly reduced as compared to a conventional apparatus.

TABLE 1

| Temperature (° C.) | Voltage (V) | Motor Operating Time (ms) | Min. Switching Time To Unlocked State (ms) | Operating Time in a Conventional Apparatus (ms) |
|---|---|---|---|---|
| RT(23 deg.) | 9 | 40.9 | 23.5 | 80.6 |
| | 12 | 31.3 | 18.1 | 64.0 |
| | 16 | 28.4 | 15.2 | 52.1 |
| +80 deg. | 9 | 49.3 | 27.2 | 84.2 |
| | 12 | 39.5 | 21.1 | 66.7 |
| | 16 | 33.6 | 17.1 | 55.5 |
| −30 deg. | 9 | 48.6 | 26.7 | 78.2 |
| | 12 | 36.4 | 18.8 | 68.8 |
| | 16 | 31.0 | 15.6 | 61.5 |

EXPLANATION OF REFERENCE NUMERALS

1 . . . vehicle door latch apparatus
10 . . . latch part
11 . . . operation part
12 . . . striker
13 . . . latch
14 . . . ratchet
15 . . . latch shaft
16 . . . latch body
17 . . . housing space
18 . . . ratchet shaft
19 . . . striker passage
20 . . . U-shaped groove
21 . . . first step
22 . . . second step
23 . . . opening lever
24 . . . outer door opening handle
25 . . . connecting part
26 . . . outer lever
27 . . . opening link
28 . . . locking lever
29 . . . sliding protrusion
30 . . . wall
31 . . . anti-panic spring
32 . . . locking lever shaft
33 . . . engaging part
34 . . . ratchet pin
35 . . . inner lever
36 . . . connecting part
37 . . . inner door opening handle
38 . . . pressing piece
39 . . . locking actuator
40 . . . motor
41 . . . cylindrical worm
42 . . . output wheel
43 . . . gear shaft
44 . . . gear part
45 . . . protruding connecting part
**45*a*** . . . first center line
46 . . . recessed connecting part
**46*a*** . . . second center line
47 . . . stopper
48 . . . stopper

What is claimed is:

1. A vehicle door latch apparatus comprising:

a latch that is engaged with a striker in order to keep a vehicle door in a half-latched state or a full-latched state;

a ratchet that is engaged with the latch in order to keep the latch engaged with the striker;

an opening link that abuts against the ratchet in order to release the ratchet from the latch when the opening link is moved in a door opening direction in an door opening operation of an outer door opening handle;

a locking lever that can be switched between a locked position that prevents the ratchet from being released by the opening link and an unlocked position that allows the ratchet to be released; and a locking actuator that switches the locking lever between the locked position and the unlocked position;

wherein the locking actuator includes a motor and an output wheel that is driven by the motor, and the output wheel has a protruding or recessed first connecting part and the locking lever has a recessed or protruding second connecting part that is connected to the first connecting part.

2. The vehicle door latch apparatus according to claim 1, wherein the first connecting part extends along a first center line that passes through a rotational center of the output wheel.

3. The vehicle door latch apparatus according to claim 2, wherein the second connecting part extends along a second center line, and the first connecting part is rotated relative to the second connecting part while changing an angle that is formed by the first center line and the second center line.

4. The vehicle door latch apparatus according to claim 1, wherein the first connecting part and the second connecting part are in point contact with each other on both sides thereof.

5. The vehicle door latch apparatus according to claim 1, wherein the first connecting part is arranged between the first stopper and the second stopper.

6. The vehicle door latch apparatus according to claim 1, wherein the output wheel is rotated within an angle of 40 degrees when the locking lever is switched between the locked position and the unlocked position.

7. The vehicle door latch apparatus according to claim 1, wherein the output wheel switches the locking lever between the locked position and the unlocked position in 28 to 50 mseconds in a temperature range of −30 to 80° C. and in a voltage range of 9 to 16V that is applied to the motor.

8. The vehicle door latch apparatus according to claim 1, wherein the output wheel causes the opening link to move to a position where the opening link can abut against the ratchet in 15 to 28 mseconds in a temperature range of −30 to 80° C. and in a voltage range of 9 to 16V that is applied to the motor.

* * * * *